United States Patent [19]

Volkmann

[11] Patent Number: 4,938,665

[45] Date of Patent: Jul. 3, 1990

[54] JET PUMP

[76] Inventor: Jurgen Volkmann, Zum Vulting 10, 4777 Schwefe-Welver, Fed. Rep. of Germany

[21] Appl. No.: 213,018

[22] Filed: Jun. 29, 1988

[30] Foreign Application Priority Data

Jun. 29, 1987 [DE] Fed. Rep. of Germany ..... 3721435

[51] Int. Cl.[5] ..... F04F 3/00; B65G 53/24

[52] U.S. Cl. ..... 417/174; 417/182; 417/186

[58] Field of Search ..... 417/151, 174, 176, 179, 417/186, 193, 198, 238; 137/833, 895

[56] References Cited

U.S. PATENT DOCUMENTS

| | | | |
|---|---|---|---|
| 714,217 | 11/1902 | Metcalfe | 417/193 |
| 3,109,581 | 11/1963 | Wilkstrom | 417/179 |
| 3,369,735 | 2/1968 | Hoffmeister | 417/174 |
| 3,959,864 | 6/1976 | Tell | 417/174 |
| 4,002,110 | 1/1977 | Teodorescu et al. | 417/174 |
| 4,379,679 | 4/1983 | Guile | 417/179 |
| 4,466,778 | 8/1984 | Volkmann | 417/174 |
| 4,696,625 | 9/1987 | Greenburg | 417/174 |

FOREIGN PATENT DOCUMENTS

| | | | |
|---|---|---|---|
| 2253932 | 9/1978 | France . | |
| 61A4899 | 6/1984 | Japan | 417/151 |
| 61A55398 | 8/1984 | Japan | 417/151 |
| 61-4899 | 1/1986 | Japan . | |
| 61-4900 | 1/1986 | Japan . | |

*Primary Examiner*—Leonard E. Smith
*Assistant Examiner*—Robert N. Blackmon
*Attorney, Agent, or Firm*—Larson and Taylor

[57] ABSTRACT

A jet pump for the suction and/or conveyance of flowable materials or mixtures of materials by means of a liquid or gaseous propellant medium consists of a housing with inlets (28, 64) as well as a common outlet or discharge (30). A flow passage (44) in the housing forms at least one propellant nozzle and at least one diffuser, to which is attached at least one suction chamber (50–56) behind the propellant nozzle (34) for the material to be conveyed. The flow passage (44) has rectangular cross section and is limited by symmetrical side limiting surfaces on separate housing walls (10, 12), between which wall elements (18, 20, 22), consisting of profile members, determine the sectional contours and dimensions for all of the lengthwise segments through the inside of the housing parallel to the plane of symmetry. A simple manufacture with use of a small number of basic parts is thus obtained, which provides for an adaptation to different capacities as well as different propellant mediums and conveyed materials.

23 Claims, 4 Drawing Sheets

JET PUMP

The invention relates to a jet pump for the suction and/or conveyance of flowable materials or mixtures of materials using a liquid or gaseous propellant, consisting of a housing provided with inlets for the propellant medium and the flowable material as well as one common outlet or discharge opening, in which a flow passage is constructed between the inlet for the propellant and the outlet, and the flow passage includes at least one propellant nozzle and at least one diffuser, and at least one suction chamber which may be connected with the inlet for the flowable material is connected behind the propellant nozzle, and the flow passage has a rectangular cross section and is limited symmetrically on two sides by surfaces between which all longitudinal cross sections parallel to the plane of symmetry have identical sectional contours and dimensions through the inside of the housing.

Jet pumps —also called "ejectors" or "injectors", depending upon the intended use— have long been known and are mainly used for the evacuation of closed hollow spaces as well as for the suction and conveyance of liquids, gases, loose materials and any sort of flowable material. With the use of so-called multi-stage ejectors, in which the diffuser of one stage at the same time forms the propellant nozzle for the next stage, and with increasing distance from the flow passage from stage to stage, it is possible to produce a vacuum of greater than 90% and up to even 99% with a great degree of precision and effectiveness. In addition to that, jet pumps are used in many different areas, especially where the generation and build-up of noise and/or heat are to be limited as much as possible and freedom from maintenance is expected.

While until this time jet pumps have generally been constructed to be rotary symmetrical in the direction of conveyance, in other words at least the flow passage including the propellant nozzle and the diffuser is of circular cross section, a single-ejector is already known from Japanese A-61-4899 and a multiple-ejector from Japanese A-61-4900, which differ basically from the jet pumps described above in that the flow passage has a rectangular cross section instead of the traditional rotary symmetrical construction and is worked into one or two housing units under the bearing pressure of massive solid block members, so that among all of the parallel longitudinal cross sections which are also parallel to the inside surfaces of the block members— they have identical cross section contours and dimensions throughout the housing block. The finished unit then is embodied so that either the housing block which is hollowed out into this form is closed by a smooth cover, which limits the flow passage on the fourth side, or two such housing blocks are mounted counter to one another in mirror image arrangement. However the manufacture of such housing blocks is difficult and costly, and complicated sectional designs such as especially the configuration of suction chambers with nozzle-like inlet openings of the suction connections discharging therefrom into the flow passage cannot be produced at all or in any case can be produced only at considerable additional cost. Also these known jet pumps implicitly include the additional drawback that the housing parts must be finished individually and no modifications of the form and dimensions of the flow passage can be undertaken to obtain modification of the capacity of the jet pump or for adaptation to some other propellant medium or respectively some other conveyor material. Thus the cost outlay is further increased and neither efficient mass production nor low-cost storage can be realized.

SUMMARY OF THE INVENTION

The object of the invention is to disclose a jet pump for the suction and/or conveyance of flowable materials and mixtures of materials with the use of a liquid or gaseous propellant medium, which can be produced simply, and, by use of only a small number of basic parts, adaption can be obtained both to different flow passage capacities and also to different propellant media and conveyor materials.

Starting from a jet pump of the aforementioned type the invention discloses the object that the side limiting surfaces of divided housing walls are formed separately, and wall elements consisting of profile members between them determine the sectional contours and dimensions.

The invention then provides a sort of assembly of unit parts which is based on only a few basic types of side walls and profile members, and said profiled side wall elements can be combined with each other in corresponding and suitable configurations to form a plurality of variations, of configuration and it is especially provided that the width of the flow passage can be varied for adaption to different media and different feed rates and charges by variation of the thickness or contours of the profile members.

Thus at the same time both a considerable freedom in the selection of the materials to be used for the housing walls and for the profile members can be enjoyed in accordance with the propellant medium being used in any particular case and whatever is appropriate for the conveying material, and also the pressure and temperature conditions in any particular case. Therefore the widest range of metals and plastics can be used, including dry powdered metals, artifical stones, sintered or unsintered ceramics, oxide ceramics, glass, and even wood, and they can be used both as solids and also in the form of coatings, of which also coatings of electrolytic surface oxidation, nickel, chrome, lacquer and so forth can be used.

There are also multiple possible methods of production of the profile members, in that they can be manufactured by die casting or by continuous casting, injection molding or vacuum molding as well as by cord extrusion. Also, very surprisingly, gas or flame cutting such as for instance plasma or laser cutting is quite suitable for the production of the profile members, since with this type of cutting, identical structural parts, for which the parameter data are programmed in one time only, are formed by repetition production, and any desired number of members can be produced proportionally and the parts can also be produced in different sizes.

The use of extruded profiles, which are executed with their longitudinal lines transverse to the direction of flow, is known in and of itself, for instance from U.S. Pat. No. 3,959,864 and French Patent No. 2,253,932, for multi-stage ejectors. However these patents have to do with one single extruded profile which is configured as a multichamber profile of metal or plastic with parallel partition walls arranged between the chambers, in which hollow cylindrical nozzles of increasing diameter are used in a series or in a plurality of series one after the other according to the arrangement of suitable boreholes. This allows no modification of the flow passage which is formed by the nozzles, nor can the channel diameter be varied as desired, as is possible in the present invention.

The invention even provides a diverging or converging arrangement of the side walls in the direction of flow, and the side walls can also be arcuate, which then requires a corresponding configuration of the end surfaces of the profile members. According to one primary feature for an advantageous configuration of the invention, it is to be provided —as is known from the aforementioned Japanese application specification— that the side walls be so configured and so arranged that the side limit surfaces are flat and run parallel to one another, so that the flow passage is of constant width along its entire length.

As a result of such a parallel flat arrangement and configuration of the side limit surfaces, another and further advantageous configurational feature of the invention can be realized, which resides in that at least one wall element can be adjusted relative to one or more other wall elements for modification of the shape and/or transverse length of the flow passage in the direction of the plane of symmetry. For this purpose, adjustments in lengthwise and also in transverse direction of the wall elements may be considered, which is simple to realize by suitable configuration and arrangement of the means with which the wall elements are held on the side housing walls.

When the flow passage runs its entire length between only two wall elements, it then suffices to construct one of these to be adjustable relative to the other. Most particularly with multi-stage jet pumps however it can also be desirable to be able to vary the width of the flow passage between its ends. In this case it is then important, according to another configurational feature of the invention, to undertake the formation of the boundary on at least one side by means of two or more wall elements lying one behind the other in the direction of flow, of which at least one is exchangeable or is selectively adjustable. For this arrangement, in still another configuration of the invention, it is an especially advantageous arrangement when the wall elements which are lying one behind the other are mounted adjustably on one common base wall element, or foundation wall element, which extends at least over most of the length of the flow passage. The setting or adjustment of the wall elements on the base wall element then occurs advantageously with the help of screw connections with lengthwise apertures and/or with exchangeable foundation elements and/or different angles between their contact surfaces on both sides. In the last case, the wall elements and their transverse axes can be swiveled through their various angle settings, and bending forces at the screw connections can be overcome in a known manner by use of screws with ball heads or swiveling bolts.

By suitable configuration of the profiles of the wall elements which are lying one behind the other it is possible to provide suction chambers located within the pump housing to the side of the flow passage, and the suction chambers are connected with the flow passage by nozzle-like narrower areas or necks. This construction is particularly advantageous for the production of a vacuum with multi-stage jet pumps, in which the suction connections opening in the flow passage with progressively increasing vacuum pressure are blocked off in sequence one after the other by nonreturn valves, up to the end when the suction channel attached at the narrowest point of the flow passage is opened. In this case, by arrangement of at least one further wall element, the invention provides for the construction of a common antechamber, which is connected with the suction chambers through apertures provided with nonreturn valves. Then the hollow space to be evacuated can be connected to the common antechamber through one single conduit, and a complicated conduit system with nonreturn valves included therein becomes superfluous as is the case in the aforementioned Japanese application, in which quite considerable flow losses occur, which are detrimental to the evacuation.

Naturally, instead of nonreturn valves, any other type of nonreturn flaps could also be used.

There are basically two structural possibilities for the arrangement of the antechamber on the suction side. On the one hand, the suction-side antechamber can be located on the outside of the basic wall element and be defined by at least one further wall element which consists of a profile member, in which case the flowthrough passage openings are located in the basic wall element. The suction-side antechamber however can also be located on the outside of one or both side walls, and then the flowthrough passage openings are arranged in this same side wall.

There are likewise various possibilities of construction for the connection of the main or basic wall elements with the side walls of the housing. The wall elements can be screwed in on the side walls. One special configurational feature of the invention however discloses the wall elements braced in alignment between and corresponding to the side walls, and then it is advantageous to have elastic supports present on the side walls, which transfer the tension loads uniformly onto the individual wall elements. Then tie rods can serve for bracing the structure, and the tie rods may extend through the inside of the housing, or else the side walls can have arms on their cross sectional ends facing one another, which arms can be joined with each other in a releasable arrangement by hook or catch fasteners. Thus it is to be understood in turn that, independent of the type and quality of connection between the wall elements and the side walls and also naturally between the wall elements which are engaged directly on one another, special care must be taken for a good packing and sealing between these wall elements.

In many cases it can be desirable to be able to change the capacity of a jet pump at the site of use and likewise even during the running of the operation. This too can be easily obtained with the arrangement according to the invention, in that according to one further configurational feature of the invention the width of the flow passage can be modified by an auxiliary side wall, which is fitted to the longitudinal cross section contour and dimensions of the flow passage and can be thrust inward into the flow passage by the action of one of the two side walls in the direction of the other side wall. The shift which is thus created can be obtained in any desired manner, for instance manually, by adjustment of one or more screw spindles, or automatically, by a spindle drive or a power cylinder dependent upon a preset program or within the scope of an automatic control loop.

Still another configuration of the invention provides that the flow passage be subdivided into a first segment by a wall element aligned in lengthwise direction, into a narrow diffuser part and a bypass channel, to which is connected a common second channel segment forming one more diffuser part. This feature is particularly advantageous with multi-stage ejectors, because with this arrangement the first propellant nozzle can be enbodied as a very narrow area, to produce a high vacuum without too great a loss of flow velocity and thus also produce a suction effect at the wider end of the flow passage.

Finally, one last configurational feature of the invention provides that two parallel flow passages are arranged within the housing, with propellant nozzles and diffusers configured integrally therein, which taper at the end into a mixing chamber. In this case, with the assembly of unit parts according to the invention, a mixing device can be obtained in a simple manner, in which two different flowable materials can be sucked in separately and be thoroughly mixed together at the end.

BRIEF DESCRIPTION OF THE DRAWINGS

The invention is to be explained in greater detail hereinafter relative to the exemplary embodiments shown in the drawings, in which.

DETAILED DESCRIPTIONS OF THE PREFERRED EMBODIMENTS

Figure 1:
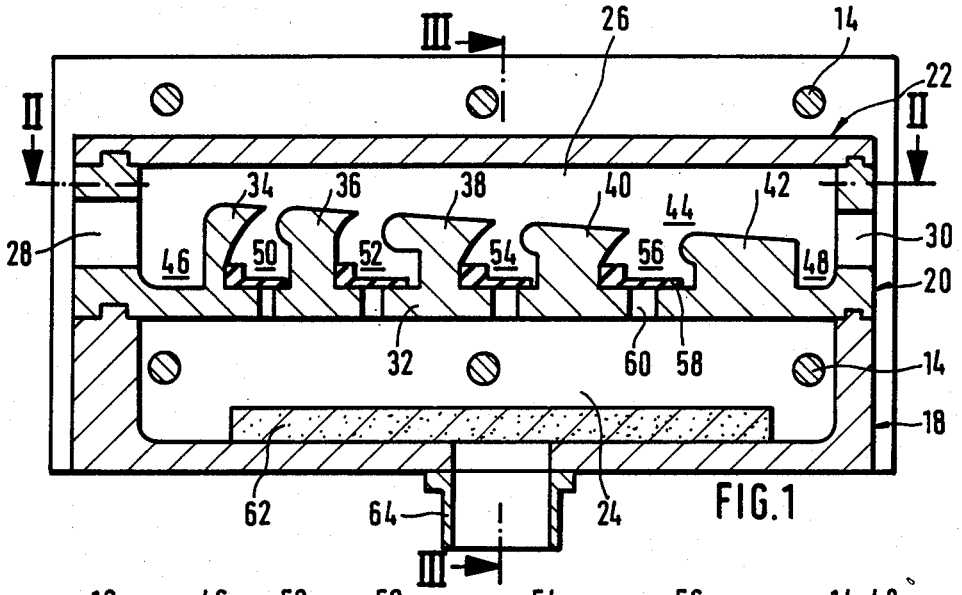
FIG. 1 is a vertical longitudinal section of a first embodiment of a jet pump according to the invention configured as a multi-stage ejector, as seen along line I—I of FIG. 2.
Figure 2:
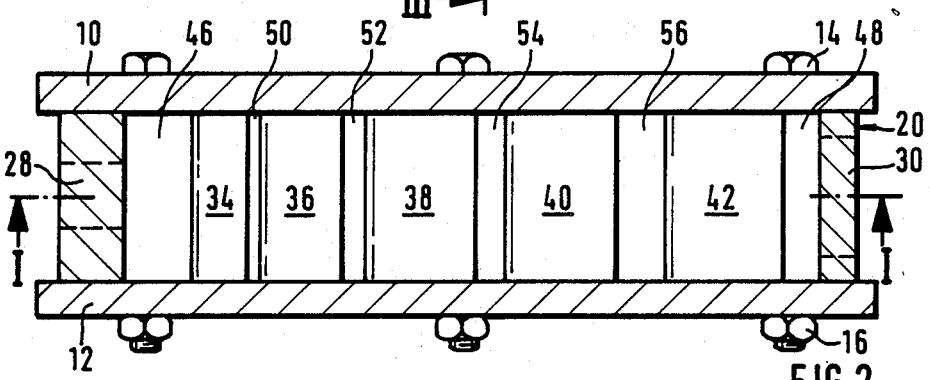
FIG. 2 is a horizontal longitudinal section as seen the same embodiment along line II—II of FIG. 1.
Figure 3:
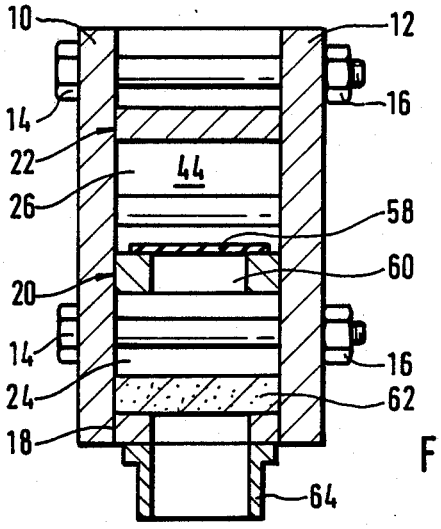
FIG. 3 is a transverse section along line III—III of FIG. 1.

FIGS. 1 to 3 show a jet pump configured as a multi-stage ejector in a first embodiment of the invention. Between two flat rectangular side walls 10, 12 are braced three wall elements 18, 20, 22, consist of profile members of the same length with different cross sectional dimensions. The terms "wall elements" and "profile members" are used interchangably hereinafter. Top wall element 22 has an elongated straight section. On the other hand, the bottom and middle wall elements 18 or respectively 20 are of generally U-shaped configurations and connect with the bracing arm ends in sealed configuration on the next lower wall elements respectively 20 or 22, so that a closed housing is formed with two inside chambers 24, 26 lying one over the other.

The top inside chamber 26 includes the actual jet pump and is provided with an inlet opening 28 at the left end for connection of the (not shown) feed line for a liquid or gaseous propellant medium and with a discharge opening 30 at the right end, which leads directly into the surrounding atmosphere. From the web wall 32 of the middle wall element which supports them, mushroom head-shaped projections 34, 36, 38, 40, 42, which slant downward at the top from left to right, form a flow passage 44 between their top limiting edges forming a line and the bottom of the top wall element 22, and flow passage 44 tapers outward from left to right to serve as a diffuser, of rectangular section, which extends between a compression chamber 46 at the inlet opening 28 and an expansion chamber 48 in front of the discharge opening 30. The narrowest point between projection 34 and wall part 22 serves at the beginning of this flow passage in a known manner as a propellant nozzle, through which flows the propellant medium at high velocity in flow passage 44 and produces a very high vacuum pressure therein, which however decreases as a result of the decreasing flow velocity when the cross section becomes larger, in order to subsequently drop almost to zero level in expansion chamber 48.

Between the bases of mushroom head-shaped projections 34, 36, 38, 40, 42 are located suction chambers 50, 52, 54, 56, which open through nozzle-like tapered areas between the head portions of the projections into flow passage 44 in the direction of flow. Suction chambers 50, 52, 54, 56 are also connected with the bottom inside chamber 24 through apertures 60 in web wall 32 provided with nonreturn valves 58, and chamber 24 then forms a common antechamber, to which can be connected the hollow space which is to be evacuated, through a filter 62 and an intake suction connecting piece 64 as well as a not shown connection line.

The aforementioned jet pump operates in a known manner so that at the beginning of the evacuation of the hollow space connected to the connecting piece 64, first of all, all of the nonreturn valves are opened by the vacuum pressure in flow passage 44 and a maximum flow volume of gas or air is suctioned through all of the suction chambers by the propellant medium in flow passage 44 and is drawn off through the discharge opening. As soon as the vacuum pressure in antechamber 24 has attained the same level which prevails at the inlet of the last suction chamber 56 in flow passage 44, the nonreturn valve which is there at that time is closed, and the evacuation is continued in smaller measure throughout the remaining suction chambers 50, 52, 54, of which the nonreturn valves are still open. In the same manner then, following further increase of the vacuum pressure in antechamber 24, then the nonreturn valve in the next-to-last suction chamber 54 also closes, and so forth, until finally only the nonreturn valve in the first suction chamber 50 remains open and only a small volume of air or gas continues to be drawn off out of the hollow space through aperture 60 in first suction chamber 50. In conclusion, also the flow through this opening is halted, and the nonreturn valve which is there will close by itself because of its inherent bias in the direction of closing.

The nonreturn valve 58 in first antechamber 50 is then no longer required for the production of the vacuum in the closed and connected hollow space, as the jet pump is being operated with the propellant medium. When its feed action is discontinued, this nonreturn valve comes into action for the production of and to maintain the vacuum in antechamber 24 and the connected hollow space.

Profile members 18, 20, 22 forming wall elements, according to their structural material, may be cast or injected in molds, extruded or cut or milled out in their entirety, with the aid of known duplicating processes. The width of the flow passage, especially following prior continuous extrusion of the structural parts, may then be determined by suitable crosscutting or cutting to length or, during duplicating, by suitable selection of the thickness of the starting material. The input apertures for the propellant medium and the material to be sucked in as well as the discharge aperture are subsequently bored or milled out corresponding to the passage width in wall elements 18 or respectively 20. Also, the angle of divergence and the width of the flow passage may be easily adapted to changing requirements, so that the profile arm of middle wall element 20 may come to be more or less shortened as compared with the quite extensive original length.

It is to be clearly understood that care must be taken to form an adequate seal between the individual parts of the jet pump, which, as shown, may be produced between wall elements 18, 20 and 22 by tongue and groove joints and between these wall elements and the side walls by (not shown) thin elastic inserts or surface coatings.

Figure 4:
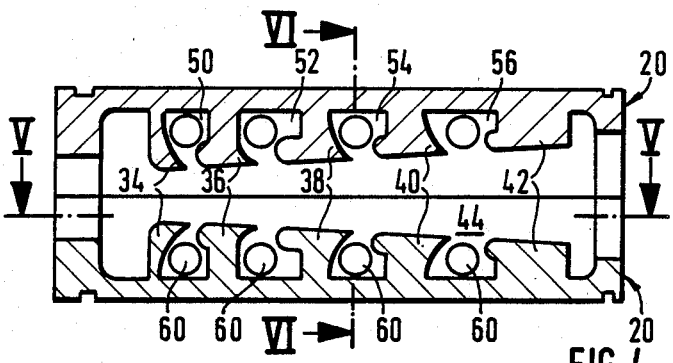
FIG. 4 is a vertical longitudinal section through a modified embodiment of a jet pump which is likewise intended for use as a multi-stage ejector, as seen along line IV—IV of FIG. 5.
Figure 5:
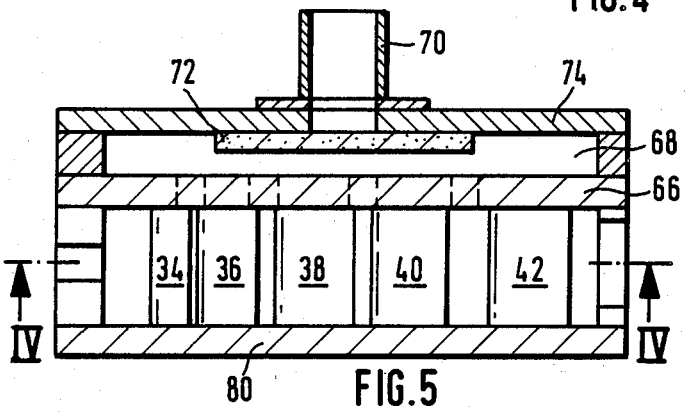
FIG. 5 is a horizontal longitudinal section of the same along line V—V in FIG. 4.
Figure 6:
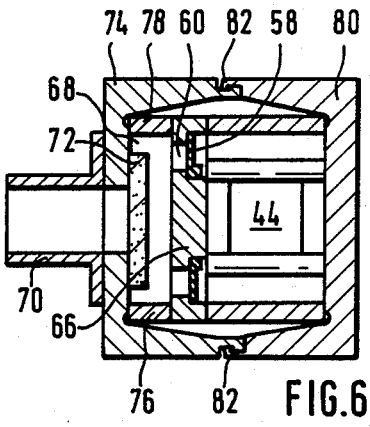
FIG. 6 is a transverse section of the same along line VI—VI of FIG. 4.

FIGS. 4 to 6 show a modified embodiment of a jet pump likewise formed as a multi-stage ejector, in which are used only two wall elements 20 of the embodiment described above, of which the profile arms and projections 34, 36, 38, 40, 42 are arranged facing each other, so that flow passage 44 is limited on both sides by the outer limiting edges of opposite and paired projections 34, 36, 38, 40, 42. In this case it is necessary to displace suction openings 60 which can be closed by nonreturn valves 58 in at least one of the particular side walls 66, 80, by which action an antechamber 68 is separated off from flow passage 44 within the pump housing, and the antechamber can be connected through a connection piece 70 with filter 72 which is there for the purpose of connecting the hollow space which is to be evacuated. Antechamber 68 is closed on the outside by a housing side wall 74 as well as on the top and bottom by horizontal walls 76, 78, while a second housing side wall 80, similar to housing wall 12 of the first exemplary embodiment, limits and defines flow passage 44 and the suction chambers on the other side.

Housing side walls 74, 80 are configured to be U-shaped in profile and on their facing profile arms have catch closures 82, which may be provided with the stipulation that side walls 74, 80 are of material of suitable elasticity, and thus can provide a rapid connection, whereupon the special tension bolts and nuts of the first exemplary embodiment are no longer used.

Naturally it is also possible to arrange antechambers 68 on both sides of the lengthwise middle plane and symmetrical to each other, provided with connection pieces 70, and the antechambers are connected through suitable apertures 60 with nonreturn valves 58 to suction chambers 50, 52, 54, 56.

Figure 7:
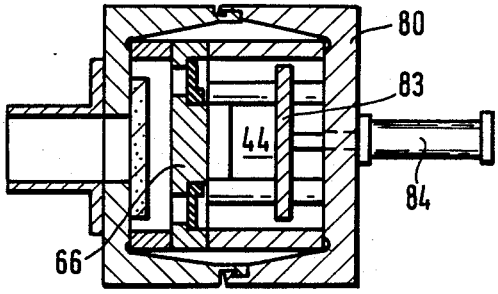
FIG. 7 is a transverse section similar to that of FIG. 6 with an additional device for continuous modification of the pump capacity.

FIG. 7 shows a modified embodiment of the jet pump as in FIGS. 4 to 6 with the special feature that an auxiliary wall 82 fitted to the profile of the flow passage and chambers 50, 52, 54 and 56, projecting out from the right housing side wall 80, can be moved over to and against the intermediate wall 66 by means of a power cylinder 84, in order to modify the width of flow passage 44 and thus also the capacity of the jet pump. Power cylinder 84 can be controlled automatically by means of a program or can be controlled within a total overall system. A control motor with a threaded spindle can also be used in its place. If the width of the flow passage is to be adjusted only from time to time, even a manually operated setting device such as one or more traditional threaded spindles may suffice.

Figure 8:
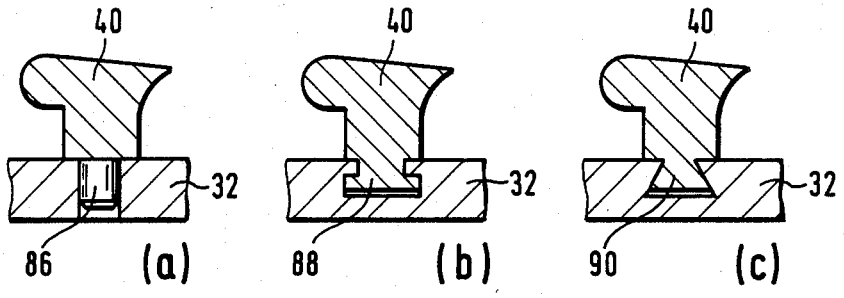
FIG. 8 is a representation of three exemplary embodiment (a), (b), (c) for the interchangeable fastening of a separate wall element forming a protrusion on a basic wall element.

In the aforementioned exemplary embodiments, the height and inclination of projections 34, 36, 38, 40, 42 as well as their spacing and therefore the size and shape of suction chambers 52, 54, 56 can be fixed and unchanging. Sometimes however it can also be desirable to adjust the spacing individually between projections 34, 36, 38, 40, 42 and to adjust the inclination of their top edges, for adaptation to the propellant medium which is being used or to the material which is being conveyed. This can be executed as shown in FIG. 8, in that the projections are configured as special wall elements and are fastened interchangeably onto web wall 32. FIG. 8(*a*) shows a fastening with a journal 86 which is engaged by press fitting or by adhesion for this purpose, and which can be easily detached under limited application of force. At (b) and (c) are shown a T-profile groove connection 88 or respectively a grooved wedge connection 90, which provide a possibility for removal of the wall parts forming the projections following the detachment of the side walls off to the side for the purpose of their exchange for wall parts of different shape and/or size.

Figure 9:
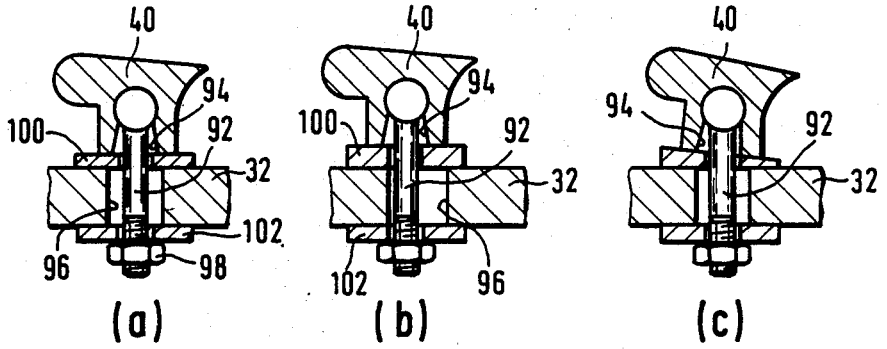
FIG. 9 is a representation of three exemplary embodiments (a), (b), (c) similar to those of FIG. 8, in which the separate wall element with a fastening means facilitating its adjustment is fastened at various different positions on the basic wall element.

FIG. 9 on the other hand displays the possibility of execution of modifications without exchange of the wall part forming the projection. This is accomplished with the aid of ball-end screws 92, of which the ball ends are fitted into a correspondingly shaped groove 94, which extends through the entire length of the profile of the wall part. Ball-end screws 92 penetrate into web wall 32 through an oblong aperture 96 and are screwed into place with nuts 98 on the inside, and on both sides of the web wall are provided foundation and adjustment elements 100, 102 in the form of straps which extend over the entire length of the profile, of which the top foundation and adjustment element 100 may be of different thickness (FIGS. 9*a* and 9*b*) or of different angle between the contact surfaces (FIG. 9*c*) of its two sides. The ball end of screw 92 thus prevents any undue bending strain of screws 92 which likewise can be obtained by use of known swing bolts.

Figure 10:
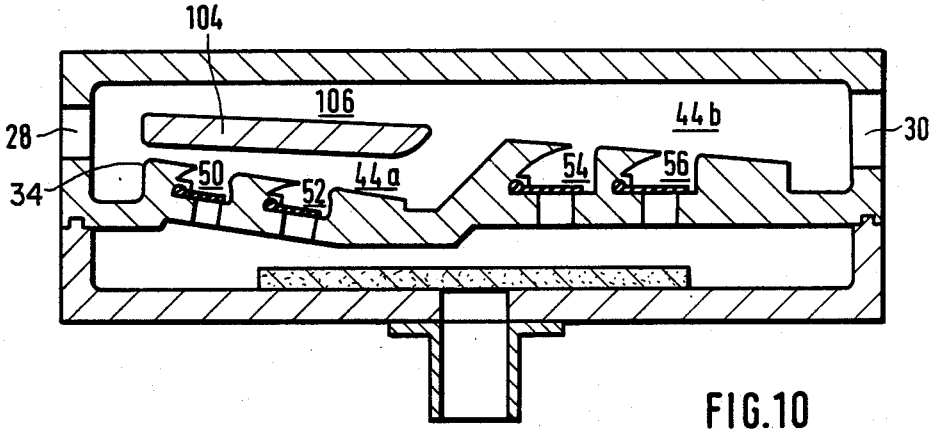
FIG. 10 is a perpendicular longitudinal section through another embodiment of the jet pump according to the invention which is intended for use as multi-stage ejector for extremely high vacuum.

FIG. 10 shows another embodiment of a jet pump which may be used as multi-stage ejector for the production of especially high vacuums. As opposed to the embodiment shown in FIGS. 1 to 3, in this embodiment the flow passage is subdivided into a first segment 44*a*, into which open suction chambers 50, 52, and a second segment 44*b*, into which open suction chambers 54, 56. With the use of a wall part 104, fastened to the side walls, a bypass passage 106 runs alongside passage segment 44*a*, which again in this case tapers between suction chambers 50, 52, with passage segment 44*a*. In this embodiment the propellant nozzle can be configured to be quite narrow between projection 34 and intermediate wall part 104 for the production of an especially high vacuum pressure without too great a drain on the flow velocity and with that the vacuum pressure in segment **44*b*, because in this segment of the flow passage additional propellant medium is available from bypass channel 106**.

Figure 11:
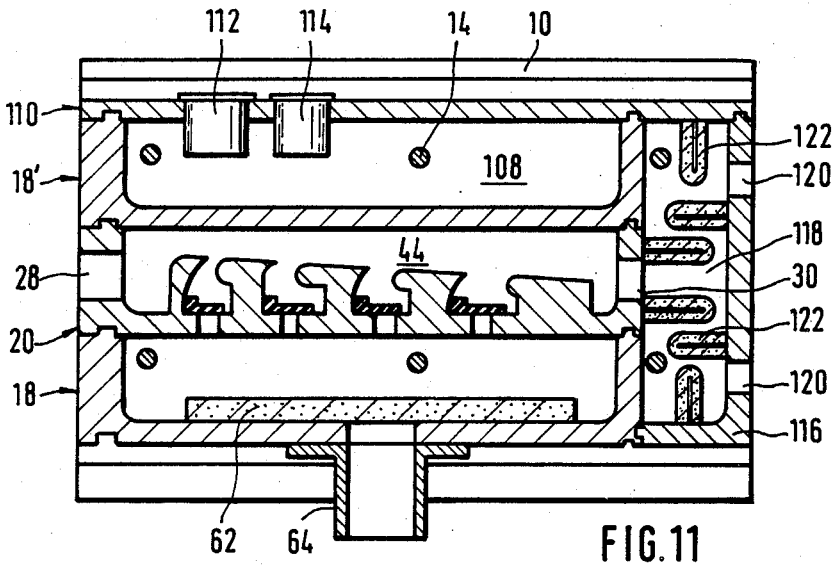
FIG. 11 is a perpendicular longitudinal section similar to that of FIG. 1 with additional devices arranged within the housing.

FIG. 11 illustrates the possibility of another construction similar to the jet pump of FIGS. 1 to 3, to be obtained by use of additional wall elements. Instead of the flat wall element 22 on the U-shaped wall element 20 as in the prior embodiment, in this case a second U-shaped wall element 18' is used, which forms a chamber 108 between its profile arms, which is closed off by a wall element 110 in the form of a flat cover. Chamber 108 can serve for instance to include reinforcement members 112, 114, which are fitted into corresponding apertures of wall element 110.

Furthermore a wall element 116 which is angular in cross section is attached to the bottom wall element 18 and extends as far as wall element 110 in the form of a cover, and the cover extends to the right over the profile arm of wall element 18' which is present at that point. As a result of this a damping, cushioning or absorption chamber 118 is provided on the outside of discharge opening 30, which is connected through discharge openings 120 provided at the level of opening 30 with the surrounding atmosphere and holds a plurality of damping or absorping elements 122, which many times over controls the mixture of propellant medium and material to be conveyed between said arrangements with a baffle-like effect within chamber 118 to thus absorb the noise arising in the propellant nozzle and in the diffuser.

Figure 12:
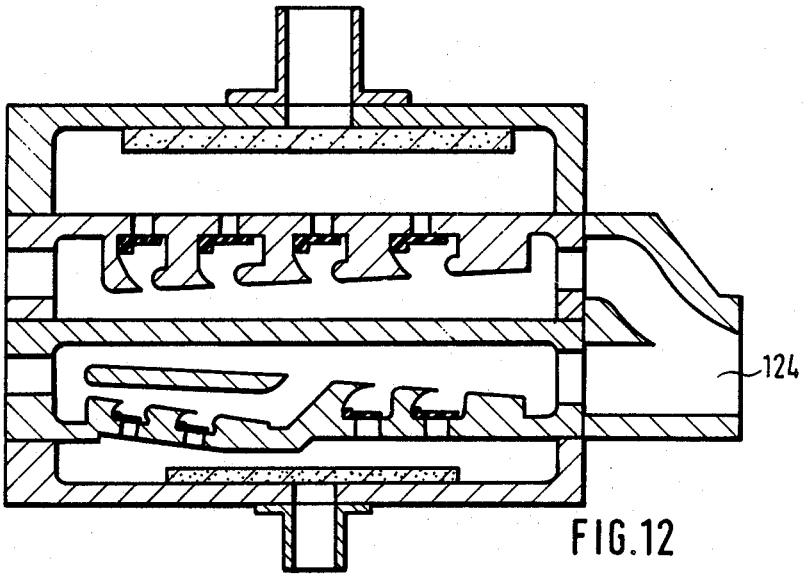
FIG. 12 is a perpendicular longitudinal section through a combination of the embodiments of FIG. 1 and FIG. 10 for the formation of a mixing pump.

FIG. 12 finally shows a combination of the jet pump embodiments of FIGS. 1 to 3 and FIG. 10 for the purpose of the thorough mixing of two materials which are different from each other and are to be conveyed, wherein the materials are first suctioned individually with the aid of two ejectors which are connected parallel to each other and the materials are conducted together into a mixing chamber 124 attached to the discharges and are there thoroughly mixed together. The mixing chamber can also consist of one or more wall elements and be incorporated with the wall elements of both jet pumps between common side walls.

I claim:

1. A jet pump for the suction and/or conveyance of flowable materials or mixtures of materials with the aid of a liquid or gaseous propellant medium, comprising a housing provided with inlets for the propellant medium and a flowable material and a common outlet, wherein a flow passage is arranged between the inlet for the propellant medium and the outlet, and within the flow passage is formed at least one propellant nozzle, at least one diffuser, and at least one suction chamber connected with the inlet for the flowable material and attached downstream from said at least one propellant nozzle; said flow passage having a rectangular cross section limited on two sides by symmetrical wall surfaces with longitudinal sections between said wall surfaces parallel to a plane of symmetry and having identical sectional contours through an inside of the housing, wherein the wall surfaces are formed of separate housing walls, between which the sectional contours and dimensions are determined by profile members and wherein at least one flow defining element, as compared with one or more other flow defining element can be adjusted for modification of a shape and/or sectional extension of the flow passage in a direction of the plane of symmetry.

2. A jet pump as in claim 1, wherein the wall surfaces of the flow passage are plane surfaces and run parallel to each other.

3. A jet pump as in claim 1 wherein the flow passage is limited on at least one side by two or more profile members aligned in a direction of flow, lying one behind the other, of which at least one may be adjusted by being interchangeable or may be otherwise selectively adjustable.

4. A jet pump as in claim 3, wherein the profile members which engage one behind the other are mounted adjustably on a common foundation profile member which extends over virtually an entire length of the flow passage.

5. A jet pump as in claim 4, wherein screw connections are provided to serve for an adjustment of the profile members on the foundation profile member, having oblong apertures and/or interchangeable underlaying or adjusting elements between their contact surfaces on both sides.

6. A jet pump as in claim 3 wherein by corresponding and suitable profile configuration of the profile members lying one behind the other within the pump housing, suction chambers are formed by being erected to the side of the flow passage, and are connected with the flow passage by nozzle-like tapers.

7. A jet pump as in claim 6, wherein at least one antechamber is constructed in the housing on a suction side, and the at least one antechamber is connected with the suction chambers through openings provided with nonreturn valves.

8. A jet pump as in claim 7, wherein the antechamber on the suction side is located on an outside of a foundation profile member and is limited by at least one surface formed by a profile member, and flow through passage openings are arranged in the foundation profile member.

9. A jet pump as in claim 7, wherein a common suction chamber is located on an outside of one or both side walls and flow through passage openings are located in this side wall.

10. A jet pump as in claim 1, wherein the profile members between side walls are braced and are sealed.

11. A jet pump as in claim 10, wherein elastic supports are present on the side walls which transfer tension forces uniformly onto individual profile members.

12. A jet pump as in claim 10, wherein the side walls have profile arms engaging against each other at their sectional ends, which can be locked in engagement with each other by catch closures.

13. A jet pump as in claim 1, wherein a width of the flow passage can be modified by an auxiliary side wall, which fits a longitudinal sectional contour of the flow passage and can be moved inward by one or both side walls toward the other side wall.

14. A jet pump as in claim 1, wherein the flow passage is subdivided into a first segment by a profile member along a length into a narrow diffuser part and a bypass channel to which is connected a second and common channel segment forming another diffuser part.

15. A jet pump as in claim 1, wherein two parallel flow passages are arranged within the housing with propellant material nozzles and diffusers formed integrally therein, which taper at an end into a mixing chamber.

16. A jet pump for the suction and/or conveyance of flowable materials, gases or mixtures thereof with the aid of a liquid or gaseous propellant medium, wherein said jet pump comprises:

(a) a housing having separate inlets for a propellant medium and a flowable material, and a common outlet;

(b) a flow passage of a rectangular cross section within said housing and between said propellant medium inlet and said common outlet, and having formed within said flow passage at least one propellant nozzle, at least one diffuser, and at least one suction chamber downstream from said at least one propellant nozzle and operatively connected with said flowable material inlet; and (c) side limiting surfaces defining said rectangular flow passage formed of separate walls and comprising two symmetrical sides and at least one side limiting surface defined by a plurality of profile members which form at least a part of said at least one propellant nozzle and said at least one diffuser and wherein at least one flow defining element is adjustable for modification of a shape or length of the flow passage.

17. A jet pump as in claim 16, wherein the side limiting surfaces comprise at least two plane surfaces that are parallel to each other.

18. A jet pump as in claim 16, wherein the flow passage is limited on at least one side by two or more profile members aligned in a direction of flow, positioned one behind the other, with a position of at least one profile member being adjustable.

19. A jet pump as in claim 16, wherein a plurality of suction chambers are formed to a side of said flow passage and are connected with the flow passage by nozzle-like tapers.

20. A jet pump as in claim 19, wherein said plurality of suction chambers are connected through openings having non-return valves to at least one antechamber within said housing.

21. A jet pump as in claim 16, wherein said flow passage is comprised of a first segment having a divider to establish a narrower first diffuser part and a bypass channel, and a second segment having a single channel that receives a flow output of said first segment and forms a second diffuser part.

22. A jet pump as in claim 16, wherein two parallel flow passages are arranged within the housing with propellant material nozzles and diffusers formed integrally within each of said flow passages which taper at an output into a mixing chamber.

23. A jet pump as in claim 22, wherein at least one of said two parallel flow passages is subdivided into a first segment having a divider to establish a narrower first diffuser part and a bypass channel, and a second segment having a single channel that receives a flow output of said first segment and forms a second diffuser part.

* * * * *